US006371291B1

(12) United States Patent
Laffy

(10) Patent No.: US 6,371,291 B1
(45) Date of Patent: Apr. 16, 2002

(54) COMBINATION GOLF BAG AND GOLF BAG COVER AND ASSOCIATED METHOD

(76) Inventor: Kurt F. Laffy, 2771-29 Monument Rd., #406, Jacksonville, FL (US) 32225

( * ) Notice: Subject to any disclaimer, the term of this patent is extended or adjusted under 35 U.S.C. 154(b) by 0 days.

(21) Appl. No.: 09/285,341

(22) Filed: Apr. 2, 1999

(51) Int. Cl.[7] ..... A63B 55/00
(52) U.S. Cl. ..... 206/315.4; 206/315.3
(58) Field of Search ..... 72/292; 220/327, 220/328, 325; 206/315.3, 315.4, 315.6

(56) References Cited

U.S. PATENT DOCUMENTS

| | | | | | |
|---|---|---|---|---|---|
| 1,644,592 | A | * | 10/1927 | Howland | 206/315.4 |
| 1,788,478 | A | * | 1/1931 | Beaty et al. | 206/315.6 |
| 1,795,880 | A | * | 3/1931 | Mullins | 206/315.4 |
| 2,509,195 | A | * | 5/1950 | Barron | 206/315.6 X |
| 2,685,530 | A | * | 8/1954 | Dire | 137/375 |
| 2,708,955 | A | * | 5/1955 | Wilkens | 206/315.6 |
| 2,749,958 | A | | 6/1956 | Innes | |
| 3,115,281 | A | * | 12/1963 | Somme | 220/327 X |
| 3,756,450 | A | * | 9/1973 | Crose, Jr. | 137/596.2 |
| 3,985,171 | A | | 10/1976 | Summers et al. | |
| 4,249,586 | A | * | 2/1981 | Setani | 206/315.4 |
| 4,442,937 | A | | 4/1984 | Delauder | |
| 4,522,300 | A | * | 6/1985 | Hamblet | 206/315.4 |
| 4,577,655 | A | * | 3/1986 | Caroli | 137/375 |
| 4,767,001 | A | | 8/1988 | Kim | |
| 4,796,789 | A | | 1/1989 | Willcocks | |
| 4,905,827 | A | | 3/1990 | Kim | |
| 4,915,221 | A | | 4/1990 | Spangler | |
| 4,961,497 | A | | 10/1990 | Sherer | |
| 5,002,185 | A | | 3/1991 | Schurman | |
| 5,050,730 | A | | 9/1991 | Suberbielle | |
| 5,209,280 | A | | 5/1993 | Gevas | |
| 5,244,086 | A | | 9/1993 | Welch | |
| 5,345,987 | A | * | 9/1994 | Hagar | 206/315.4 X |
| 5,458,240 | A | | 10/1995 | Rich et al. | |
| 5,699,906 | A | | 12/1997 | Lombardo et al. | |
| 6,029,813 | A | * | 2/2000 | Smolenski | 206/315.4 |

* cited by examiner

*Primary Examiner*—Allan N. Shoap
*Assistant Examiner*—Tri M. Mai
(74) *Attorney, Agent, or Firm*—Allen, Dyer, Doppelt, Milbrath & Gilchrist, P.A.

(57) ABSTRACT

An apparatus and method for a combination golf bag and golf bag cover, the combination including a golf bag having at least an inner cavity for holding golf clubs, an open upper end communicating with the cavity for receiving golf clubs, and at least one divider positioned generally within the open upper end for dividing at least the open upper end to thereby define compartments within the inner cavity for separating the golf clubs when positioned therein, and a golf bag cover which includes a cover body having an open lower end positioned to abuttingly contact upper peripheries of the open end of the golf bag, a closed upper end, and a fastener connected to a divider of the golf bag and positioned to connect to the cover body to thereby secure the cover body onto the golf bag.

6 Claims, 5 Drawing Sheets

42
27
28
22
24

42
32
27
22

34
38
44
36
44
38
32
30
34
36

COMBINATION GOLF BAG AND GOLF BAG COVER AND ASSOCIATED METHOD

FIELD OF THE INVENTION

The present invention relates to the field of providing protection for golf clubs and, more particularly, to a golf bag and golf bag cover combination wherein the golf bag cover attaches to the golf bag by connecting to a divider in the golf bag.

BACKGROUND OF THE INVENTION

Most persons who play golf have a golf bag for storing and carrying their golf clubs. It is known that golf bags, when purchased new, are generally provided with some sort of protective cover that serves to close the open end of the golf bag, enclosing the golf clubs. These covers are usually soft-sided, fabric or plastic covers which attach to the golf bag by connecting to snaps positioned around the exterior periphery of the bag's open end. These covers do not provide meaningful protection from impact for the golf clubs. In addition, there remains the problem of security, since these generally available covers neither lock onto the golf bag nor otherwise prevent an unauthorized person from easily removing golf clubs from the golf bag. An example of such covers is seen in U.S. Pat. No. 3,985,171 which provides a soft-sided golf bag cover attaching to the outside periphery of the open end of the golf bag and does not allow for secure locking of the golf bag. U.S. Pat. No. 5,209,280 is for a two-piece, hard shell golf bag hood which may be taken apart to store flat and provides protection for the golf clubs but is not easily lockable and attaches to the outside of the mouth of the golf bag, thereby being easily removable by someone intending on removing golf clubs. For those reasons, standard golf bag covers such as these do not provide adequate protection for the golf clubs while the golfer is traveling. So that for travel protection, the golfer must generally buy a full, hard-sided case into which to place the entire golf bag. The golfer, essentially, has to buy a container for the golf bag. These travel cases are usually capable of being locked, to deter potential thieves; however, they are expensive, cumbersome and heavy, so that they are not amenable to daily use and are usually reserved for extended travel.

SUMMARY OF THE INVENTION

With the foregoing in mind, the present invention is a combination golf bag and golf bag cover. The invention advantageously provides a protective cover for a golf bag, which is simple, inexpensive, lightweight, easy to use, suitable for locking, impact resistant, and adaptable to most golf bags, thereby solving the shortcomings of previously known golf bag covers. The golf bag has at least an inner cavity for holding golf clubs, an open upper end communicating with the cavity for receiving golf clubs, and at least one divider positioned generally within the open upper end for dividing at least the open upper end to thereby define compartments within the inner cavity for separating the golf clubs when positioned therein. The golf bag cover includes a cover body having an open lower end positioned to abuttingly contact upper peripheries of the open end of the golf bag, a closed upper end, and a fastener connected to a divider of the golf bag and positioned to connect to the cover body, to thereby secure the cover body onto the golf bag. The cover is preferably made of impact resistant material, such as a hard plastic. The cover includes a cover body which is connected by a fastener to a divider in the golf bag, thereby securing the golf bag cover onto the golf bag. The fastener connects to a divider in the golf bag by engaging with the divider preferably by a hook or by a clamp. The cover body is connected to the fastener, which is in turn connected to the divider, thereby securing the golf bag cover onto the golf bag. The upper end of the fastener is disposed through an opening which extends through the upper end of the cover body and the cover body is secured onto the upper end of the fastener by a nut or similar means. The golf bag cover is preferably provided with a lock, for added security once the cap is in properly positioned on the golf bag.

The present invention also includes an associated method of protectively covering the open end of a golf bag having at least an inner cavity for holding golf clubs, an open upper end for receiving golf clubs communicating with the cavity, and at least one divider positioned generally within the open upper end for dividing at least the open upper end to thereby define compartments for separating the golf clubs when positioned therein, the method including the step of connecting a golf bag cover to the divider to thereby secure the golf bag cover onto the open end of the golf bag. The method further includes the step of providing a lock for locking the golf bag cover onto the golf bag.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art.

Figure 1:
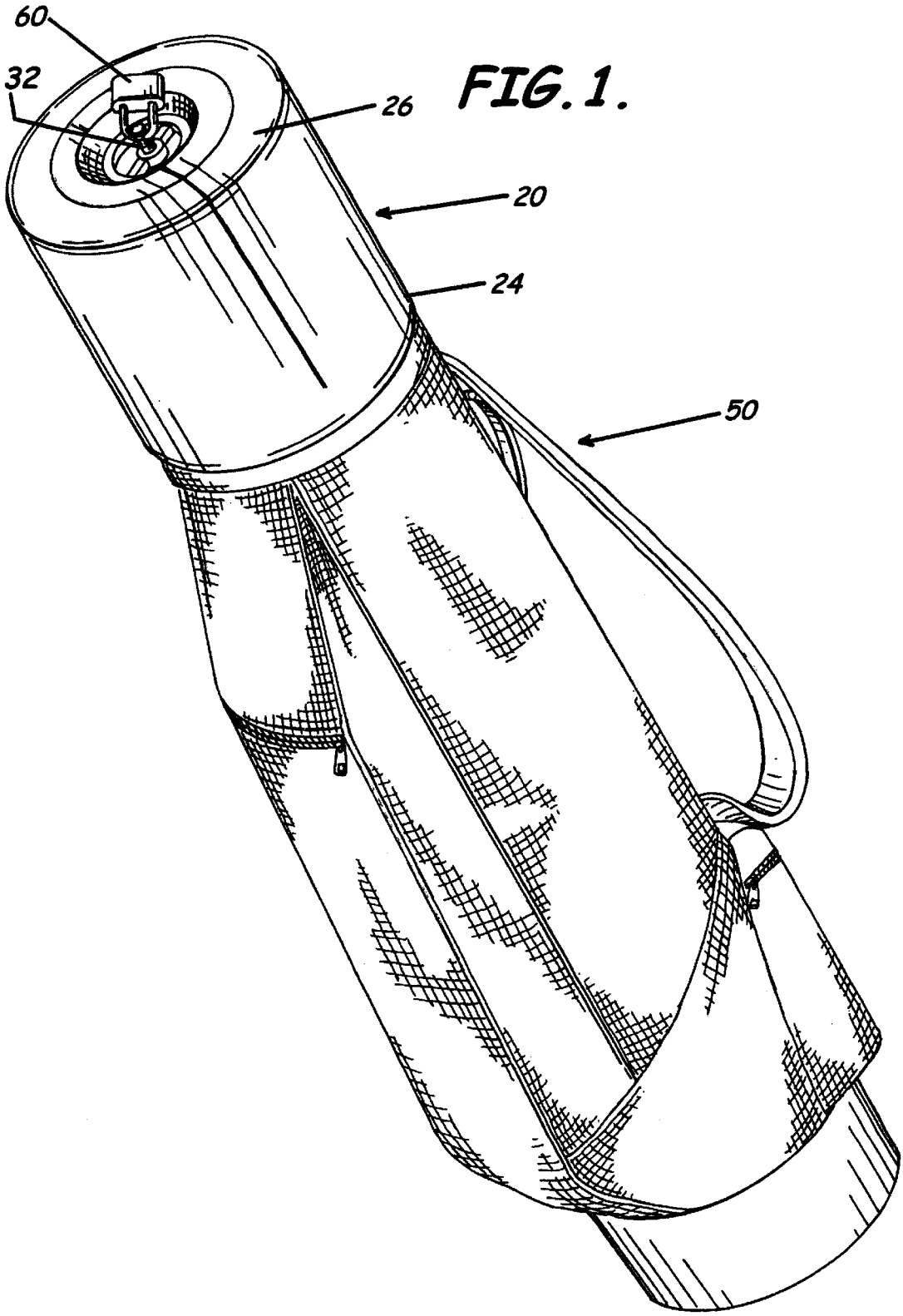
FIG. 1 illustrates the golf bag cover in place on a golf bag, the cover being locked by a padlock.

FIG. 1 illustrates an overall view of the golf bag 50 and golf bag cover 20 combination having the golf bag cover 20 as it would be properly positioned on the golf bag 50, protectively enclosing the upper open end 54 of the golf bag 50. The combination golf bag 50 and golf bag cover 20 shown in various views in FIGS. 1 through 9 includes a golf bag 50 having at least an inner cavity for holding golf clubs, an open upper end 54 communicating with the cavity and serving for receiving golf clubs, and at least one divider 52 positioned generally within the open upper end 54 of the golf bag 50 for dividing at least the open upper end 54 into compartments for separating the golf clubs when positioned therein. The golf bag may be soft-sided, having a frame for support or may be made of a rigid yet light-weight material such as molded plastic, thus not requiring a frame for support. The golf bag cover 20 includes a cover body 22 having an open lower end 24 positioned to abuttingly contact the upper peripheries of the open end of the golf bag 50, a closed upper end 26, and a fastener 30 connected to a divider 52 of the golf bag 50 and positioned to connect to the cover body 22 to thereby secure the cover body 22 onto the golf bag 50. For added protection for the golf clubs, the combination golf bag 50 and golf bag cover 20 shown in FIG. 1 may be made of an impact resistant material, such as molded light-weight plastic.

The golf bag cover 20 attaches to the golf bag in a novel way by connecting to a divider in the golf bag and thereby provides advantages not previously available. FIGS. 2, 4–6, 8 and 9 illustrate details of the golf bag cover 20 showing the opening 28 extending through the upper end of the cover body 22. A fastener 30 for connecting the cover body to the divider is shown having a fastener upper end 32 extending through the opening 28 in the cover body 22. The cover body tightening means are used to thereby secure the cover body 22 to the fastener upper end 32. The golf bag cover 20 preferably includes a recess 27 positioned on the upper end of the cover body 22, the opening 28 being located within the recess 27 so that the fastener upper end 32 extends through the opening 28 into the recess 27 and the cover body tightening means is housed within the recess 27 when positioned on the fastener upper end 32 to thereby secure the cover body 22 to the fastener upper end 32.

Figures 2, 3, 4:
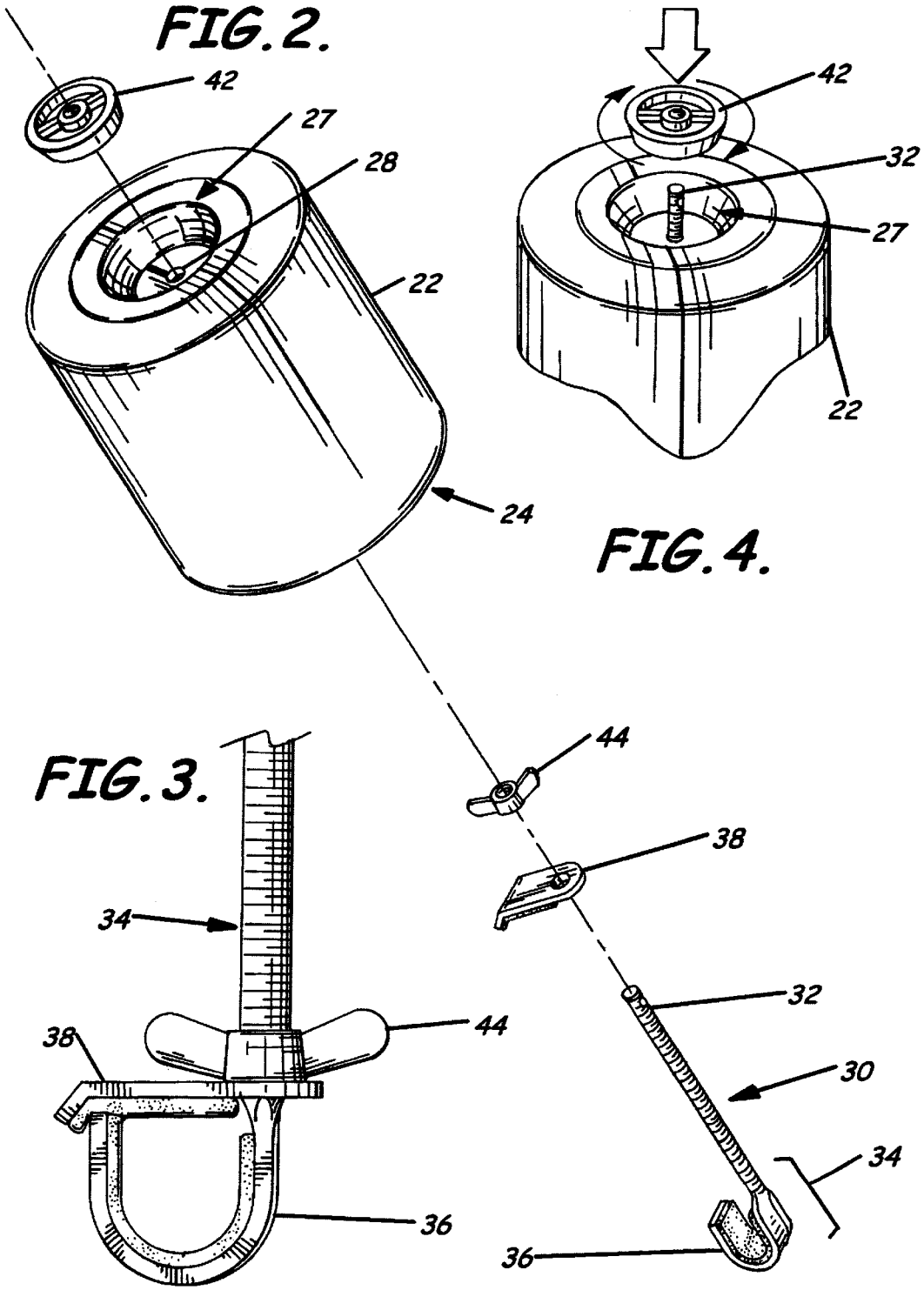
FIG. 2 is an exploded view of the positional relationship between the cover body and the fastener.
FIG. 3 is a detail view of the fastener lower end.
FIG. 4 is a detail view of the recess on the upper end of the cover body.
Figure 10:
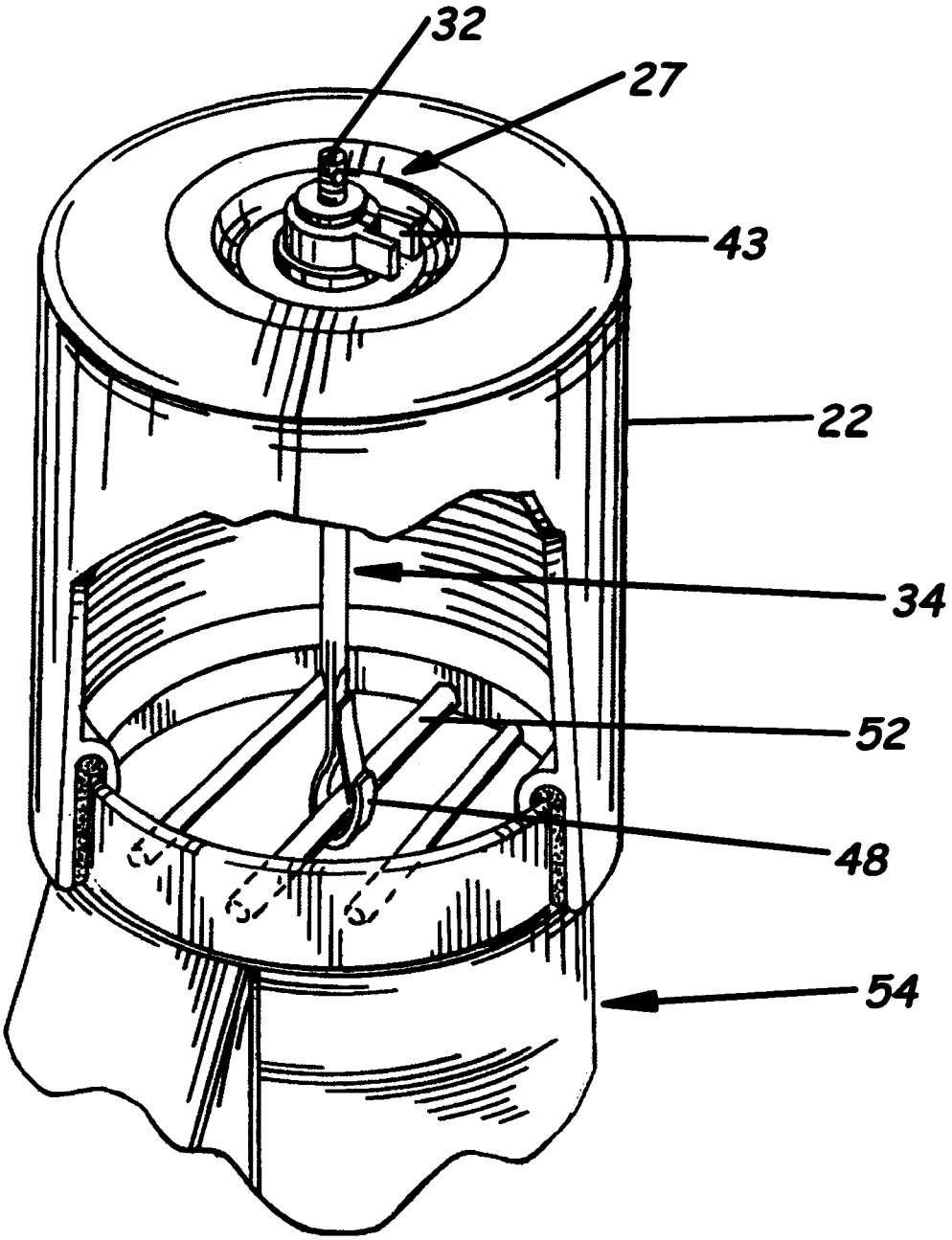
FIG. 10 shows an alternate embodiment of the cover body, wherein the fastener includes a snap hook.

In one preferred embodiment of the invention, as seen in FIG. 2, the fastener upper end 32 has threads and the cover body tightening means is a nut 42 positioned on the fastener upper end 32 to thereby secure the cover body 22 to the fastener 30 by tightening down on the cover body. An alternate embodiment of the cover body tightening means is shown in FIG. 10, wherein a pressure coupling barrel 43, as known to those having skill in the art, is shown positioned on the fastener upper end 32 to thereby secure said cover body 22 to the fastener 30. A pressure coupling barrel 43 provides the advantages of being faster to mount and dismount than a standard threaded nut 42. In addition to a threaded nut 42 and a pressure coupling barrel 43, other means known to those skilled in the art may also be used to secure the cover body 22 onto the fastener upper end 32.

Figure 5:
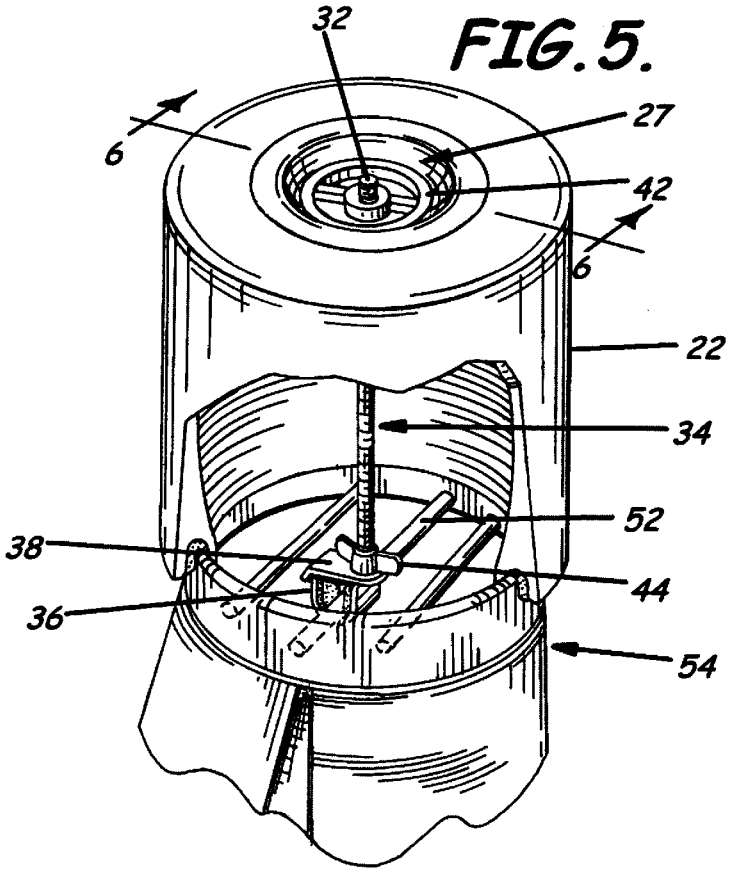
FIG. 5 is a cutaway view of the golf bag cover properly positioned on the golf bag.
Figure 8:
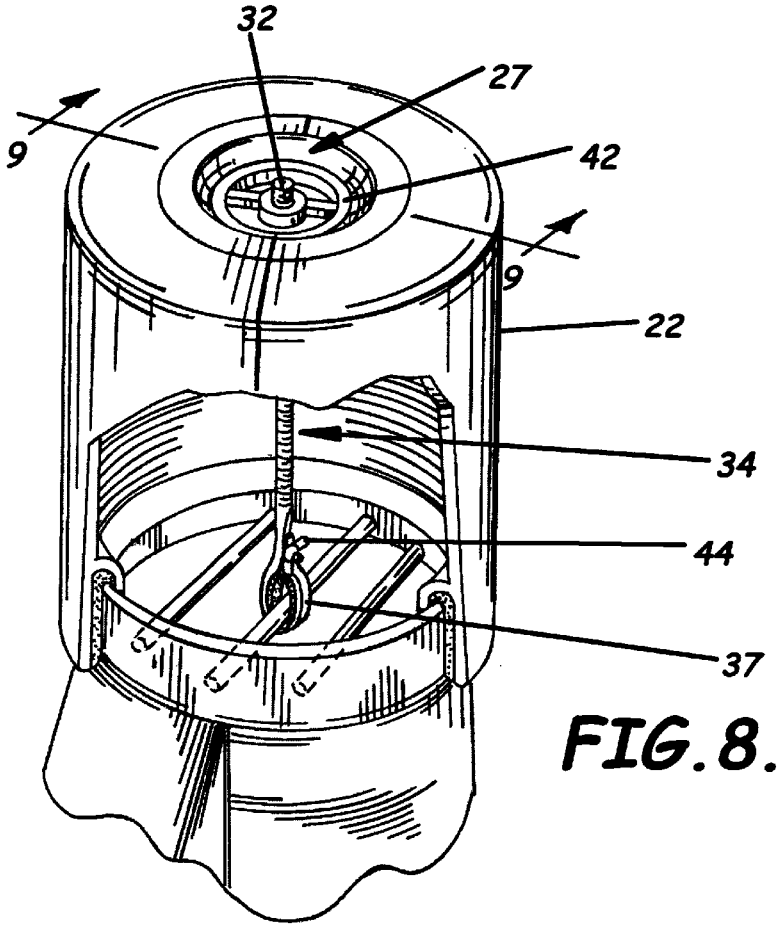
FIG. 8 shows an alternate embodiment of the cover body having a flange to engage the golf bag.

The fastener 30 provides attachment to the divider 52 in the golf bag 50 and is connected to the cover body 22, thereby serving to attach the golf bag cover 20 onto the golf bag 50, as shown in FIGS. 5, 8 and 10. The fastener 30 has divider connecting means positioned on the fastener lower end 34 for connecting with the divider 52, which is generally positioned just inside the open upper end 54 of the golf bag 50. The divider connecting means may have various embodiments.

In one preferred embodiment of the invention the divider connecting means is a hook 36 defining the fastener lower end 34 to thereby connect with the divider 52 which is positioned generally within the open upper end 54 of the golf bag 50. Hook tightening means positioned on the fastener lower end 34 are added for securing the hook 36 to the divider 52. FIG. 3 illustrates a hook 36 for engaging the divider 52, having the fastener lower end 34 including threads and the hook tightening means being a nut 44 positioned on the fastener lower end 34 to thereby secure the hook 36 to the divider 52. In addition, the hook tightening means shown in FIG. 3 includes a movable tab 38 positioned below the nut 44 to thereby close the mouth of the hook 36, securing the hook 36 onto the divider 52. In yet another preferred embodiment of the invention, the hook tightening means includes a pressure coupling barrel 43 positioned on the fastener lower end 34 to thereby secure the hook 36 to the divider 52. A pressure coupling barrel is easy to use and may be set up quickly. In addition, if a pressure coupling barrel is used, there is no need for providing threads on the fastener 30, which may save manufacturing expense.

Figure 7:
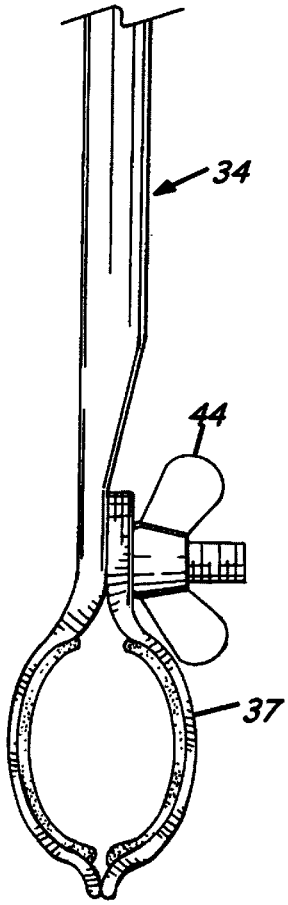
FIG. 7 is a detail view of an alternate embodiment having a clamp on the fastener lower end.

The divider connecting means may also be a clamp 37 and clamp tightening means positioned on the fastener 30 lower end for securing the clamp 37 to the divider 52, as best shown in FIGS. 7 and 8. The clamp tightening means includes a nut 44 positioned on the fastener lower end 34 to thereby secure said clamp 37 to the divider 52. In addition, as also noted above, an alternate embodiment of the clamp tightening means may be a pressure coupling barrel 43 positioned on the fastener lower end 34 to thereby secure the clamp 37 to the divider 52 positioned generally within the open upper end 54 of the golf bag 50.

Yet an additional preferred embodiment of divider connecting means is shown in FIG. 10. As illustrated, the divider connecting means may be a hook embodiment which is a snap hook 48, thereby the hook tightening means is the gate portion of the snap hook 48, which secures the hook by snapping back to close the mouth of the hook once the hook is connected in place. It should be appreciated that various divider connecting means may additionally be employed, as known to those having skill in the art, to secure the fastener 30 to the divider 52 in the golf bag 50, for example, various types of clamps, hooks and connectors.

Figure 6:
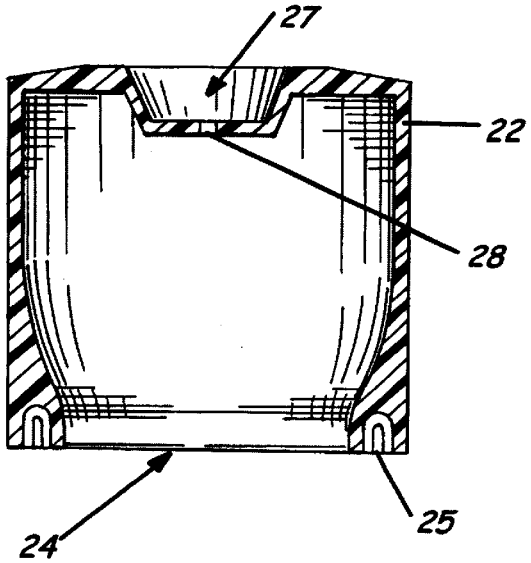
FIG. 6 is a cross sectional view of the cover body in the embodiment including a groove positioned along its rim.
Figure 9:
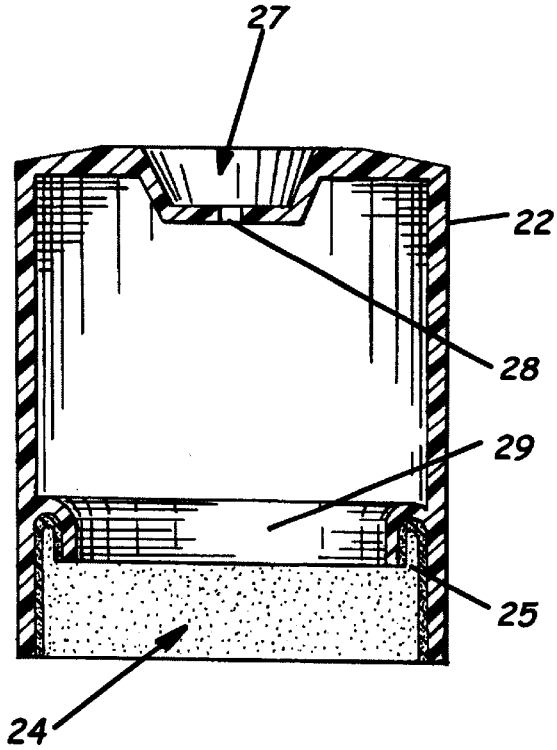
FIG. 9 illustrates a cross sectional view of the cover body in the embodiment including a flange.

As shown in FIGS. 5, 6, 8 and 9, the combination golf bag 50 and golf bag cover 20 also includes golf bag engaging means positioned on a periphery of the open lower end 24 of the cover body 22 to thereby engage the golf bag cover 20 with the golf bag 50 when the golf bag cover 20 is properly positioned on the golf bag 50. More specifically, as best shown in FIGS. 5 and 6, the golf bag engaging means can be a groove 25 positioned along the rim of the open lower end 24 of the cover body 22 to thereby engage the open upper end 54 of the golf bag 50 by receiving the open upper end 54 of the golf bag 50 within the groove 25 when the golf bag cover 20 is properly positioned on the golf bag 50. In addition, an alternate embodiment of the golf bag engaging means is shown in FIGS. 8 and 9, as a flange 29 positioned along an interior periphery of the open lower end 24 of the cover body 22 to thereby engage the open upper end 54 of the golf bag 50 by receiving the open upper end 54 of the golf bag 50 within the flange 29 when the golf bag cover 20 is properly positioned on the golf bag 50. As seen in FIG. 8, this embodiment allows the open lower end 24 of the cover body 22 to overlap the open upper end 54 of the golf bag 50, to thereby result in a sturdier engagement between the golf bag cover 20 and the golf bag 50.

The combination golf bag 50 and golf bag cover 20 may also include golf bag cover 20 locking means positioned on the golf bag cover 20 to thereby lock the golf bag cover 20 in place when properly positioned on the golf bag 50. The golf bag cover 20 locking means may be a padlock 60 positioned on the fastener 30, as shown in FIG. 1, to thereby lock the golf bag cover 20 in place when the golf bag cover

20 is positioned on the golf bag 50. Additional locking means may be adapted to the present invention, for example, a pressure coupling barrel 43 having an integral lock, which is an arrangement similar to that of a locking lug nut for a wheel on a car, and others as known to those having skill in the art.

A further advantage of the combination golf bag 50 and golf bag cover 20 of the present invention, results from the golf bag cover 20 being properly positioned onto the golf bag 50 providing a combination having coextensive outer surfaces to thereby facilitate carriage and transport of the combination.

As illustrated in FIGS. 1 through 9, the present invention also includes a method for protectively covering the open end of a golf bag 50 having at least an inner cavity for holding golf clubs, an open upper end 54 for receiving golf clubs communicating with the cavity, and at least one divider 52 positioned generally within the open upper end 54 for dividing at least the open upper end 54 to thereby define compartments for separating the golf clubs when positioned therein, the method including the step of connecting a golf bag cover 20 to the divider 52 to thereby secure the golf bag cover 20 onto the open end of the golf bag 50. The method may also include the added step of providing a lock for locking the golf bag cover 20 onto the golf bag 50.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A combination golf bag and golf bag cover, said combination comprising:

a) a golf bag having at least an inner cavity for holding golf clubs, an open upper end communicating with said cavity for receiving golf clubs, and at least one divider positioned generally within said open upper end for separating the golf clubs when positioned therein; and b) a removable golf bag cover which includes a cover body having an open lower end positioned to engage upper peripheries of the open end of said golf bag, an upper end having an opening therethrough, and a fastener extending from said at least one divider of the golf bag through said opening in said upper end thereon having a cover body tightener for securing the cover body onto the golf bag so as to substantially close the golf bag.

2. The combination of claim 1, further comprising a recess positioned on the upper end of said cover body such that the opening is located within the recess, the fastener upper end extends through the opening into the recess and the cover body tightening means is housed within the recess when positioned on the fastener upper end to thereby secure the cover body to the fastener upper end.

3. The combination of claim 1, wherein said fastener upper end further comprises threads and said cover body tightening means comprises a nut positioned on the fastener upper end to thereby secure said cover body to the fastener.

4. The combination of claim 1, wherein a fastener lower end comprises threads and a hook tightener having a nut positioned thereon to secure said hook to the divider.

5. The combination of claim 1, wherein said golf bag cover comprises a groove positioned along a rim of the open lower end to thereby engage the open upper end of the golf bag.

6. A golf bag cover for protectively covering a golf bag, said golf bag cover comprising:

a) a removable cover body having an upper end comprising a recess having an opening therethrough, and an open lower end adapted to engage upper peripheries of an open upper end of the golf bag; and b) a fastener having an upper end extending through the opening into the recess and a lower end connecting with a divider in the golf bag, said fastener adapted to receive a cover body tightener housed within the recess to thereby secure the cover body on the golf bag.

* * * * *